United States Patent [19]

McBeth

[11] Patent Number: 4,642,032

[45] Date of Patent: Feb. 10, 1987

[54] AXIAL PISTON PUMP INCLUDING BALL PISTON

[75] Inventor: James McBeth, North Vancouver, Canada

[73] Assignee: Teleflex Incorporated, Limerick, Pa.

[21] Appl. No.: 763,300

[22] Filed: Aug. 7, 1985

[51] Int. Cl.[4] ..... F04B 1/12; F04B 21/04

[52] U.S. Cl. ..... 417/269; 417/554

[58] Field of Search ..... 91/499, 489; 417/269, 417/495, 554

[56] References Cited

U.S. PATENT DOCUMENTS

| | | | |
|---|---|---|---|
| 2,292,181 | 8/1942 | Tucker | 91/489 |
| 2,941,475 | 6/1960 | Blair | 417/269 X |
| 3,116,698 | 1/1964 | Kramer | 91/504 |
| 3,228,346 | 1/1966 | Johnson | 91/489 |
| 3,303,749 | 2/1967 | Occule | 91/499 |
| 3,357,363 | 12/1967 | Raymond | 417/495 X |
| 3,482,525 | 12/1969 | Di Bartolo et al. | 91/499 |
| 3,514,223 | 5/1970 | Hare | 417/554 X |
| 3,738,228 | 6/1973 | Harrison | 91/499 |
| 3,935,796 | 2/1976 | Wood | 91/504 |
| 4,092,905 | 6/1978 | Wood | 91/490 |
| 4,263,814 | 4/1981 | Takaoka | 74/60 |

FOREIGN PATENT DOCUMENTS

| | | | |
|---|---|---|---|
| 731939 | 4/1966 | Canada | 417/269 |
| 48108 | 8/1981 | Japan | 91/499 |
| 1068078 | 5/1967 | United Kingdom | 91/501 |

*Primary Examiner*—Louis J. Casaregola
*Assistant Examiner*—Paul F. Neils
*Attorney, Agent, or Firm*—Reising, Ethington, Barnard, Perry & Milton

[57] ABSTRACT

An axial piston pump assembly includes a housing having first and second interconnected housing portions (12,14). A cylinder barrel (18) has an axis of rotation and is rotatably supported in the housing about the axis of rotation. The cylinder barrel (18) includes a plurality of pistons (22). The pistons (22) are reciprocally supported in the each of the piston cavities (20) for reciprocating movement parallel to the axis of rotation reacting with a cam surface (30) and causing the reciprocating movement of the pistons (22). The pistons (22) include a body portion (44) having a longitudinally extending central bore (46). One end of the bore (46) defines a fluid inlet (48) into the bore (46) and the other end defines a fluid outlet (51). The fluid inlet (48) includes a ball seat (50) and a ball member (52) seated therein and substantially over the fluid inlet (48), the ball member (52) engaging the cam surface (30).

7 Claims, 4 Drawing Figures

AXIAL PISTON PUMP INCLUDING BALL PISTON

TECHNICAL FIELD

The instant invention relates to a pump and, specifically to an axial piston pump of the type particularly suited for use in a hydraulic steering system for controlling the movements of an outboard motor or rudder of a marine boat.

BACKGROUND ART

Axial piston pumps have been used in various environments and are particularly well suited for use in marine steering assemblies wherein hydraulic lines extend from the steering position on the boat to a rudder or outboard engine for controlling an actuator for pivoting the rudder or outboard engine for controlling the direction of the boat. In a typical situation, a steering wheel, or the like, is connected to a shaft of an axial piston pump whereby, upon rotation of the axial piston pump, hydraulic fluid is directed from the pump to one side or the other of the actuator for steering the boat. Such a pump is shown in the U.S. Pat. No. 4,092,905 to Wood, issued June 6, 1978.

Generally, pump assemblies of the type to which the subject invention relates include a housing having first and second interconnected portions with a cylinder barrel supported in the housing and a plurality of pistons reciprocatively supported in a plurality of piston cavities in the cylinder barrel for reciprocating movement. A cam reacts with the pistons for causing the reciprocating movement as either the cylinder barrel or the cam is rotated. The cam reacts with the pistons to move the pistons between a position where the cavities in which they are disposed are at a minimum pumping volume to an intake position where the cavities are at a maximum intake volume. During the compression stroke of the pistons for creating the pumping action there is a reaction force, because of the pressure of the fluid created by the pistons, which reacts between the pistons and the cylinder barrel forming the piston cavities. These reaction forces are transmitted to the two housing portions which are connected together in a manner to force the housing portions apart or to place the housing portions in tension.

Ball pistons have been used in a variety of situations as parts of fluid pumps. For example, the U.S. Pat. Nos. 735,248 to Hahn, issued Aug. 4, 1903 and 2,095,553 to McGee, issued Oct. 12, 1937, disclose pumps including ball check valves. The U.S. Pat. No. 2,941,475 to Blair, issued June 21, 1960 discloses a hydraulic pump wherein balls engage a cam surface.

Prior art ball piston assemblies included a body having an inlet in the crown of the piston and an outlet at the opposite end. A check valve system is disposed between the inlet and outlet for controlling the fluid flow between the inlet and outlet ports.

In hydraulic pumping systems, particularly hand operated systems used for steering boats, it is important to remove all air from the oil for proper operation. The use of valves, such as the check valves, which direct return oil directly to the tank and inlet check valves in each piston aid in flushing air from the system. The optimum configuration has the inlet check valves in the crown of the piston and outlet at the end of the bore. The piston is always oriented so that the inlet is level with or below the outlet. In this way, air is flushed directly out of the piston bore since there are no traps for the air as in systems with the inlet check valves in the piston bore. Another important aspect of manually operated hydraulic steering systems is the smoothness of operation. Systems containing pistons with hardened or chrome plated balls in the piston crown provide the smoothest operation.

Present designs of pistons containing inlet check valves in the crown have a hole in the center of the crown. This system has several draw backs. The contact point between the piston and the seat or race for the ball is offset from the centerline of the piston which increases side load and reduces efficiency and life of the system. The contact area on the side of the hole in the piston crown does not slide as smoothly on the race as a more conventional round end piston. The hardness and friction characteristics of the material at the point of contact are limited to that of the piston material or expensive plating systems. Since the angle of the race is usually 10° to 15°, the inlet area is restricted, thereby increasing the pressure drop and the possibility of cavitation. In order to provide a smooth contact area at the desired angle, the piston end must be machined which adds cost.

STATEMENT OF THE INVENTION

According to the present invention, there is provided a piston pump assembly including housing means and a cylinder barrel having an axis of rotation. The cylinder barrel is rotatably supported in the housing means about the axis of rotation. The cylinder barrel includes a plurality of piston cavities. The assembly further includes cam means and piston means reciprocatively supported in each of the piston cavities for reciprocating movement and for reacting with the cam means and causing the reciprocating movement of the piston means. The piston means includes a body portion having a longitudinally extending central bore, one end of the bore defining a fluid inlet into the bore and the other end of bore defining a fluid outlet. The assembly is characterized by the fluid inlet including a ball seat and a ball member seated therein and substantially over the fluid inlet, the ball member rotatably engaging the cam means.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
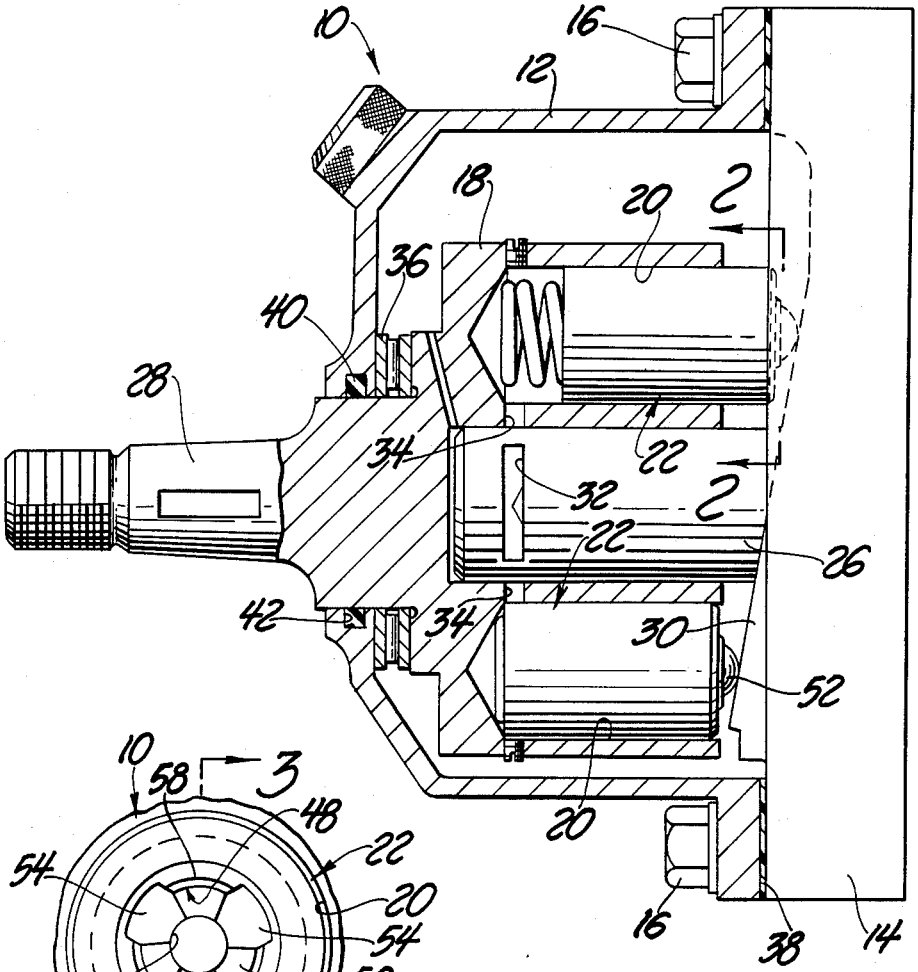
FIG. 1 is a partially broken away cross sectional view of an embodiment of the subject invention.

An axial piston pump assembly constructed in accordance with the instant invention is generally shown at 10 in the Figures. The assembly 10 includes housing means including a first cup shaped closing portion 12 and a second housing portion 14 in the form of a cover or closure plate. The first and second housing portions 12 and 14 are interconnected by bolts 16. The cup-shaped housing 12 defines a tank for containing hydraulic fluid and surrounds a cylinder barrel 18. The cylinder barrel 18 has an axis of rotation and is rotatably supported in the housing means about the axis of rotation. The cylinder barrel 18 includes a plurality of piston cavities 20 in which are reciprocatively supported a plurality of pistons generally indicated at 22. The cylinder barrel 18 is rotatably supported on a spigot shaft 26 which is, in turn, rigidly secured to the closure or cover plate 14. A shaft portion 28 is rotatably supported in the cup-shaped housing 12 and extends from and is integral with the cylinder barrel 18. The inner face of the cover 14 provides a cammed surface 30. The spigot shaft 26 includes a fluid outlet port 32 and another fluid outlet port on the opposite side thereof (not shown). The outlet ports are in communication with fluid passages within the shaft 26 which lead to fluid connections in the pump assembly. A fluid port 34 extends from each piston cavity 20 to the spigot shaft 26 for fluid communication with the ports for outlet of fluid during rotation of the cylinder barrel 18 for directing fluid flow from the piston cavities 20.

As the cylinder barrel 18 rotates and the pistons 22 react with the cam surface 30 for pressurizing fluid in the piston cavities 20, a reaction force results between the pistons 22, and the cylinder barrel 18 to urge the cylinder barrel 18 to the left, against a thrust bearing 36. Such a reaction force places the cup-shaped housing portion 12 in tension along its side walls therefore requiring that the housing portion 12 be a structural member. A further seal 38 is disposed between the cover 14 and cup-shaped housing 12 and an annular seal 40 is disposed about the shaft portion 28 in a annular groove 42 in the cup-shaped housing 12.

The piston means 22 is reciprocally supported in each of the piston cavities 20 for reciprocating movement parallel to the axis of rotation about the spigot shaft 26 for reacting with the cam surface 30 and causing the reciprocating movement of the piston means 22. The piston means 22 includes a body portion 44 having a longitudinally extending central bore 46. One end of the bore 46 defines a fluid inlet 48 into the bore 46 and the other end of the bore 47 defines a fluid outlet 51. The assembly 10 is characterized by the fluid inlet 48 including a ball seat 50 and a ball member 52 seated therein and substantially over the fluid inlet 48, the ball member 52 rotatably engaging the cam surface 30.

Figure 2:
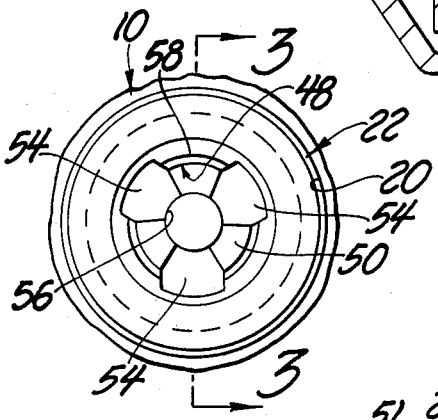
FIG. 2 is an enlarged cross sectional view taken substantially along 2—2 of FIG. 1.
Figure 3:
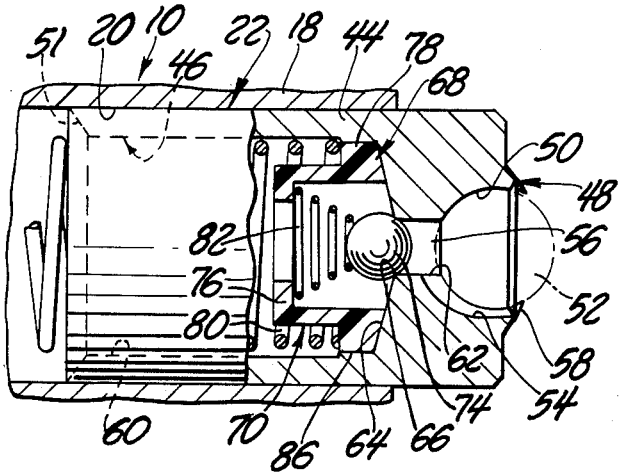
FIG. 3 is a fragmentary cross sectional view taken substantially along lines 3—3 of FIG. 2.

More particularly, the seating surface 50 includes a plurality of grooves 54 extending from the fluid inlet 48 to the remainder of the bore 46 for facilitating fluid flow around the ball member 52. As shown in FIG. 2, the ball seat 50 includes three equally spaced ones of the grooves 54. The grooves 54 provide a path for oil around the ball member 52 into a centerline hole 56 which forms the ball seat 50 at its inner end.

The piston may be formed from powdered metal, but other processes such as forging might also be utilized. The use of the powdered metal process produces a finished ball seat. The only secondary operation required may be to complete the piston crown by swagging the ball member 52 into place thereby forming a lip 58. The ball seat area may be designed so that only a square ended press is required. Because of the simplicity of these operations, the total cost of the subject invention is approximately equal to the cost of prior art straight through hole designs. The performance of the instant invention however is much improved. This is because the low friction and close to centerline contact of the ball member 52 produces a smoother operating pump with a longer operating life and higher pressure capability. When used in hydraulic steering pumps, the instant invention provides the combined advantages of a ball ended piston with optimum air bleeding capability.

The bore 46 includes an enlarged main portion 60 extending along substantially the length of the piston 22 and a secondary portion 62 including the centerline hole 56 at one end thereof. The secondary portion 62 is in fluid communication between the main bore 60 and the fluid inlet 48. The secondary portion 62 has a smaller diameter than the main bore 60.

The main bore 60 includes a terminal wall 64 having an opening 66 therethrough defining the secondary bore 62. The assembly 10 includes check valve means generally indicated at 68 disposed at the terminal wall 64 for allowing one way fluid flow from the secondary bore 62 to the main bore 60. In other words, the check valve means 68 is at the fluid inlet end or crown portion 48 of the piston means 22.

The check valve means 68 includes a check ball 74 disposed adjacent to the secondary bore 62 and biasing means for biasing the check ball 74 against the second bore 62 and for allowing one way fluid flow through the secondary bore 62 to the main bore 60. More particularly, the biasing means includes support member 70 having a hub portion 76 and a rim portion 78 and an external spring member 80 disposed within the main bore 60 and engaging the rim portion 78 to bias the support member 70 against the terminal wall 64. AN internal spring member 82 is disposed between the hub portion 76 and the check ball 74. Fluid pressure through the inlet 48 forces the ball 74 against the spring 82 to allow fluid flow through hub portion 76 and into the main bore 60. In other words, the piston means 22 includes the spring 80 disposed within the main bore 60 for biasing the rim portion 78 against the terminal wall 64. The piston means 22 further includes a plurality of ribs 86 extending radially into the main bore 60 adjacent to the terminal wall 64, the rim portion 78 being seated within the ribs 86 and aligned thereby.

In operation, on the suction stroke of the piston means 22, oil will flow around the ball member 52 through the grooves 54 in the ball seat 50 and into the secondary bore 62. The check valve means 68 will then be unseated in response to a decrease in the internal pressure and the oil will flow into the main bore 60 filling the cavity substantially. On the return stroke, the check valve means 68 will be quickly closed as the direction of the pressure is reversed and the oil held in the main bore 60 will be pumped out the open outlet end 51 of the piston means 22.

Figure 4:
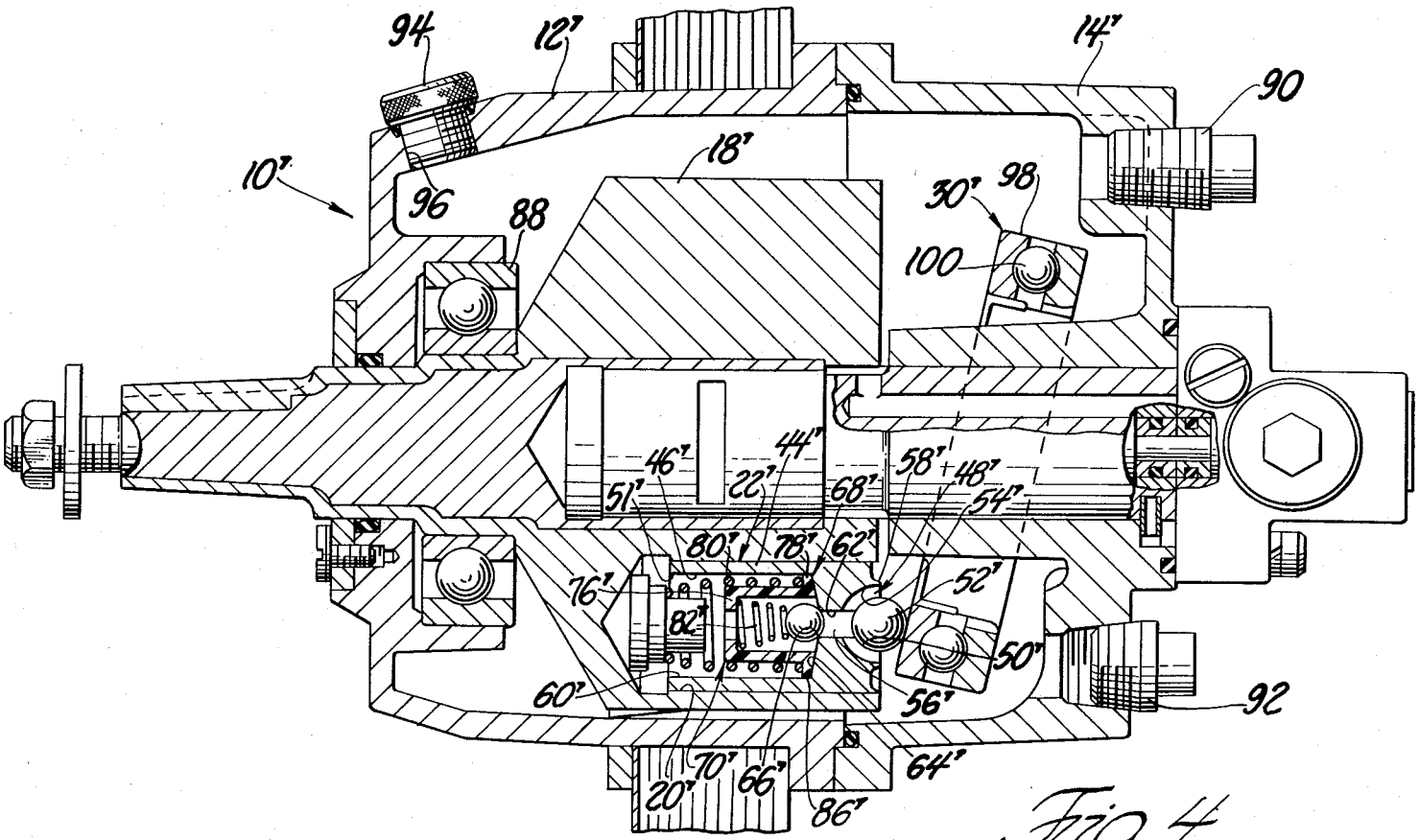
FIG. 4 is a cross sectional view of a second embodiment of the instant invention.

A second embodiment of the instant invention is shown in FIG. 4. Primed like numerals are used to indicate similar structure between the two embodiments.

The assembly generally shown at 10′ includes two housing halves 12′ and 14′. The cylinder barrel 18′ is supported on roller bearings generally indicated at 88. The assembly includes a plurality of fluid inlets 90,92 in the cover portion 14′ and a cap member 94 disposed over a bleed outlet 96 in the other housing halve 12′. The cam means 30 in this embodiment comprises a roller bearing housing 98 housing roller bearings 100. The ball member 52′ of each of the piston assemblies 22′ rides over the bearing housing 98, the inner race of the bearing housing 98 moving with the ball member 52′. In other words, the ball member 52′ need not rotate as the inner bearing of the housing 98 moves with the rotating cylinder 18′. In other respects, the piston assembly 22′ is identical to the piston assembly 22 previously described.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A piston pump assembly (10,10′) comprising: housing means; a cylinder barrel (18,18′) having an axis of rotation and being rotatably supported in said housing means about said axis of rotation, said cylinder barrel (18,18′) including a plurality of piston cavities (20,20′); cam means (30,30′); and piston means (22,22′) reciprocally supported in each of said piston cavities (20,20′) for reciprocating movement and reacting with said cam means (30,30′) and causing said reciprocating movement of said piston means (22,22′), said piston means (22,22′) including a body portion (44,44′) having a longitudinally extending central bore (46,46′), one end of said bore (46,46′) defining a fluid inlet (48,48′) into said bore (46,46′) and the other end of said bore (46,46′) defining a fluid outlet (51,51′), said assembly (10,10′) characterized by said fluid inlet (48,48′) including a ball seat (50,50′) and a ball member (52,52′) seated therein and substantially over said fluid inlet (48,48′), said ball member (52,52′) engaging said cam means (30,30′), said seating surface (50,50′) including at least one groove (54,54′) extending from said fluid inlet (48,48′) to the remainder of said bore (46,46′) for facilitating fluid flow about said ball member (52,52′), said bore (46,46′) including an enlarged main portion (60,60′) extending along substantially the length of said piston means (22,22′) and a secondary portion (62,62′) in fluid communication between said main bore (60,60′) and said fluid inlet (48,48′) and having a smaller diameter than said main bore (60,60′), said main bore (60,60′) including a terminal wall (64,64′) having an opening (66,66′) therethrough defining said secondary bore (62,62′), a check ball (74,74′) disposed adjacent to said secondary bore (62,62′) and biasing means for biasing said check ball (74,74′) against said secondary bore (62,62′) for allowing one way fluid flow through said secondary bore (62,62′) to said main bore (60,60′), said biasing means including a support member (70,70′) having a hub portion (76,76′) and a rim portion (78,78′), an external spring member (80,80′) disposed within said main bore (60,60′) and engaging said rim portion (78,78′) for biasing said support member (70,70′) against said terminal wall (64,64′) and an internal spring (82,82′) disposed between said hub portion (76,76′) and said check ball (74,74′) for urging said check ball (74,74′) into sealing engagement with said secondary bore (62,62′).

2. An assembly as set forth in claim 1 further characterized by said ball seat (50,50′) including a centerline hole (56,56′) and three equally spaced ones of said grooves (54,54′) extending from fluid inlet (48,48′) to said centerline hole (56,56′).

3. An assembly as set forth in claim 1 further characterized by said piston means (22) including a plurality of ribs (86,86′) extending radially into said main bore (60,60′) adjacent to said terminal wall (64,64′), said rim portion (78,78′) being seated within said ribs (86,86′).

4. An assembly as set forth in claim 1 further characterized by said housing means including first and second interconnected housing portions (12,12′,14,14′).

5. An assembly as set forth in claim 1 further characterized by including ball retaining means (58) for retaining said ball member (52) within said ball seat (50).

6. An assembly as set forth in claim 5 further characterized by said ball retaining means including a peripheral lip (58) extending radially into said fluid inlet (48).

7. A piston assembly for an axial piston pump having cam means (30, 30′) comprising: piston means (22,22′) including a body portion (44,44′) having a longitudinally extending central bore (46,46′), one end of said bore (46,46′) defining a fluid inlet (48,48′) and the other end of said bore (46,46′) defining a fluid outlet (51,51′), said assembly (22,22′) characterized by said fluid inlet (48,48′) including a ball seat (50,50′) and a ball member (52,52′) seated thereon and substantially over said fluid inlet (48,48′z), said ball member (52, 52′) for engaging the cam means (30,30′), said ball seat from said fluid inlet (48,48′) to the remainder of said central bore (46,46′) for allowing fluid flow about said ball member (52,52′), said bore (46,46′) including an enlarged main portion (60,60′) extending along substantially the length of said piston means (22,22′) and a secondary portion (62,62′) in fluid communication between said main bore (60,60′) and said fluid inlet (48,48′) and having a smaller diameter than said main bore (60,60′), said main bore (60,60′) including a terminal wall (64,64′) having an opening (66,66′) therethrough defining said secondary bore (62,62′), a check ball (74,74′) disposed adjacent to said secondary bore (62,62′) and biasing means for biasing said check ball (74,74′) against said secondary bore (62,62′) for allowing one way fluid flow through said secondary bore (62,62′) to said main bore (60,60′), said biasing means including support member (70,70′) having a hub portion (76,76′) and a rim portion (78,78′), an external spring member (80,80′) disposed within said main bore (60,60′) and engaging said rim portion (78,78′) for biasing said support member (70,70′) against said terminal wall (64,64′) and an internal spring (82,82′) disposed between said hub portion (76,76′) and said check ball (74, 74′) into sealing engagement with said secondary bore (62, 62′).

* * * * *